US011877608B1

(12) United States Patent
Stuckey

(10) Patent No.: US 11,877,608 B1
(45) Date of Patent: Jan. 23, 2024

(54) HAND PROTECTING DEVICE AND METHOD

(71) Applicant: Carl Stuckey, Hilton Head Island, SC (US)

(72) Inventor: Carl Stuckey, Hilton Head Island, SC (US)

( * ) Notice: Subject to any disclaimer, the term of this patent is extended or adjusted under 35 U.S.C. 154(b) by 0 days.

(21) Appl. No.: 18/076,931

(22) Filed: Dec. 7, 2022

(51) Int. Cl.
*A41D 13/08* (2006.01)

(52) U.S. Cl.
CPC ..... *A41D 13/081* (2013.01)

(58) Field of Classification Search
CPC ..... A41D 13/081; A41D 19/01594; A41D 19/1582; A46B 5/04; A46B 2200/3053; B25G 1/102; A47J 45/061
See application file for complete search history.

(56) References Cited

U.S. PATENT DOCUMENTS 2,257,456 A * 9/1941 Crockford ..... A47L 13/022 15/229.13
2,814,060 A * 11/1957 Aschenbach ..... A46B 11/0041 401/39
2,820,236 A * 1/1958 Crowther ..... A47L 13/022 15/145
2,958,889 A * 11/1960 Greenblatt ..... A46B 5/04 24/DIG. 43
6,081,958 A * 7/2000 Van Staagen ..... A46B 5/04 15/159.1
6,810,553 B1 * 11/2004 Otsuji ..... A45D 19/00 15/210.1
2004/0009027 A1 * 1/2004 Gadberry ..... B43K 23/001 401/6
2006/0213033 A1 * 9/2006 Wasserman ..... A47J 45/061 16/431
2006/0230559 A1 * 10/2006 Knopow ..... A47L 25/08 15/187
2010/0043113 A1 * 2/2010 Clark ..... A41D 13/082 2/20
2010/0263149 A1 * 10/2010 Ballmaier ..... A46B 5/021 15/167.1
2012/0124764 A1 * 5/2012 Watanabe ..... A46B 9/023 15/160
2013/0206790 A1 * 8/2013 Pauze ..... A47G 23/0258 220/604
2016/0130037 A1 * 5/2016 Ou ..... B65D 25/2802 220/755

(Continued)

*Primary Examiner* — Jillian K Pierorazio
(74) *Attorney, Agent, or Firm* — Lowndes; Stephen C. Thomas; Robert R. Fredeking

(57) ABSTRACT

A device and method for protecting the hands, knuckles and fingers of a user using an elongate tool such as a straightening bar to apply a desired straightening force to a structure to be straightened, such as sheet metal structure, using a fulcrum-lever approach to apply straightening force to the structure. The hand protecting device may comprise a base portion and a grip portion molded in one piece. The user's hand may grip the device while the structure of the device prevents crushing of the user's hand when the device is used at the fulcrum point, between the elongate tool and a fulcrum structure. The device and method of the system allow the user to use their hand to make needed adjustments to the placement of the elongate tool to apply the desired straightening force, without crushing the hand of the user when the straightening force is applied.

10 Claims, 7 Drawing Sheets

(56) References Cited

U.S. PATENT DOCUMENTS

| | | | | |
|---|---|---|---|---|
| 2017/0086611 | A1* | 3/2017 | Truog | A47G 21/06 |
| 2017/0188728 | A1* | 7/2017 | Votolao | A47J 47/16 |
| 2017/0303677 | A1* | 10/2017 | Xavier | B08B 1/001 |
| 2017/0347727 | A1* | 12/2017 | Bailey | A63B 71/143 |
| 2018/0078028 | A1* | 3/2018 | Lentz | A46B 1/00 |
| 2018/0085816 | A1* | 3/2018 | Henry | B21D 22/14 |
| 2018/0125298 | A1* | 5/2018 | Workman | A47J 45/062 |
| 2018/0168379 | A1* | 6/2018 | Delaforce | B26B 27/007 |
| 2019/0016515 | A1* | 1/2019 | Borg | B65D 71/50 |
| 2019/0075914 | A1* | 3/2019 | Teper | B65D 23/12 |
| 2019/0274667 | A1* | 9/2019 | Freshly | B25G 1/102 |
| 2020/0015581 | A1* | 1/2020 | Lentz | A46B 9/005 |
| 2021/0127823 | A1* | 5/2021 | Gaither | A46B 11/0065 |

* cited by examiner

HAND PROTECTING DEVICE AND METHOD

CROSS REFERENCE TO RELATED APPLICATIONS AND INCORPORATION BY REFERENCE

[Not applicable]

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The field of the invention relates generally to systems, devices and methods for protecting the hands, knuckles and/or fingers of a user who is performing work on an object or structure that requires the application of forces to such object, especially in case in which a fulcrum-lever manual technique for applying such forces. A non-limiting example of a use of the device and method of the invention is in the performing of sheet metal straightening during automobile body repair work. This is but one of many uses of the hand protecting tool of the invention. The hand protecting tool prevents injury to the user's hands, knuckles and fingers by preventing applied loads from being applied directly to the user's hands and fingers, especially when the user's hand is located at, or near, the fulcrum point of a tool, such as an elongate tool, that is used to remove deformities from a structure or surface to be straightened.

It is often the case that certain structures, including but not limited to sheet metal structures such as body portions of automobiles, trucks and trailers, are damaged when used such as, for example, that often occurs when one vehicle impacts another vehicle in an accident, or wreck. In such cases, the body structures of one or more of the vehicles may be damaged by disfiguring forces that cause deformation such as denting, creasing, crushing or other deforming or disfiguring forces. It is usually desired that the deformed surface(s) of the body be restored to their original, undeformed, smooth surface quality in which the deformations have been removed.

Often, a straightening bar or tool is used to remove deformations in, or straighten, a structure to be straightened. In this operation, a straightening bar, which may be an elongate tool having a rectangular or other cross section, placed such that a first end of the straightening bar is in contact with a portion of the structure to be straightened at a point along the structure to be straightened for which is desired to straight the structure such that it in contact with a fulcrum point at a point along the length of the straightening bar, and a force is then applied to a second end of the straightening bar, such that when the force is applied to the second end of the straightening bar, the first end of the straightening bar applies a desired straightening force to the structure to be straightened at the point along the structure to be straightened for which is desired to straighten the structure (i.e., remove an unwanted deformity in the structure to be straightened). In the manner, a fulcrum-lever arrangement is used to apply a desired straightening force to a point on a structure for which it is desired that deformities be removed, returning the structure to be straightened to a desired shape.

This procedure is usually carried in manual fashion by a user. However, it is often desired that minute adjustments in the location of the straightening bar contact point on the fulcrum and on the structure to be straightened be made in order to apply just the right amount of straightening force at just the right location on the structure to be straightened. A great deal of skill may be required in order to make the minute adjustments. Usually, this means that a user is required to place one of their hands at the fulcrum point, between the straightening bar and the fulcrum point so that the point of contact of the first end of the straightening bar on the structure is in exactly the right location so that the desired straightening force is applied to the structure to be straightened. Once the minute adjustments are made, the force is applied to the second end of the straightening bar, tending to crush the hand of the user between the straightening bar and the fulcrum point. In some cases, this crushing force is high enough to cause physiological damage to the user's hands resulting in numbness, pain, and in some case, nerve or other physiological damage to the user.

What is needed in the art, therefore, is an apparatus and/or method adapted to protect the hand, knuckles and fingers of a user when that user uses a straightening bar, or any elongate structure, to apply straightening forces to a structure to be straightened using the above, or similar, methods.

BRIEF SUMMARY OF THE INVENTION

The present invention comprises an apparatus and method that have one or more of the following features and/or steps, which alone or in any combination may comprise patentable subject matter.

In embodiments, the hand protecting device may comprise a loop-like structure having an opening for receiving the fingers, knuckles and/or hand of a user, the loop structure, which, in embodiments, may be continuous, may act as a fulcrum point for the use of a straightening bar, i.e. any elongate structure, to straighten a surface in a structure in a desired fashion. The loop may form an opening for receiving the fingers, knuckles and/or hand of a user when the hand protecting device is in use by the user.

In embodiments, the hand protecting device may comprise a base portion and a grip portion. The grip portion may be formed of a band of material having a longitudinal axis, the band of material having a first end and a second end, and the band of material having a thickness and a width. The base portion may have a thickness. The band first end may be connected to a first end of the base portion, and the band second end may be connected to a second end of the base portion, such that the band grip portion and the base portion together form an opening for receiving at least a portion of the hand of a user. The base portion and grip portion may be formed of a unitary structure, meaning that they may be formed of a continuous material, such that the base portion and the grip portion form a single continuous structure.

In embodiments, the unitary structure may be formed by molding.

In embodiments, the base portion and the grip portion may be comprised of a plastic material.

In embodiments, the grip portion may have a curvilinear cross sectional shape in a direction transverse to the longitudinal axis of the band of material forming the grip portion, the curvilinear cross sectional shape forming a concave side of the grip portion, and the concave side of the curvilinear cross sectional shape may be oriented away from the base portion.

In embodiments, the concave side of the grip portion may comprise a plurality of voids to provide a non-skid surface to prevent the elongate tool from sliding along the concave side of the grip portion band of material when a force is applied to the second end of the elongate tool. The elongate tool may be, for example, a straightening bar.

In embodiments, a bottom surface of the base portion may comprise a plurality of voids to provide a better gripping surface when the bottom side of the base portion is in contact with a fulcrum structure.

In embodiments, the grip portion may comprise a straight portion that is straight in a plane that is parallel with the longitudinal axis of the band of material forming the grip portion, the straight portion having a length L1. The plurality of voids in the grip portion may extend for the length of the straight portion, or the plurality of voids in the grip portion may extend for a greater or lesser length than the straight portion.

In embodiments, the invention comprises a method for protecting a hand of a user using an elongate tool to straighten a structure using the tool to apply a straightening force to the structure with a fulcrum point located in the proximity of the user's hand, comprising the steps of providing a structure to be straightened; providing a fulcrum structure; providing the elongate tool, the elongate tool having a first end and a second end; providing a hand protecting device, the hand protecting device comprising a base portion and a grip portion; wherein the grip portion is formed of a band of material having a longitudinal axis, the band of material having a first end and a second end, and the band of material having a thickness and a width; the base portion has a thickness; the band first end is connected to a first end of said base portion, and the band second end is connected to a second end of said base portion, such that the band grip portion and the base portion form an opening for receiving at least a portion of the hand of a user; placing the hand protecting device on the fulcrum structure, and gripping the hand protecting device with one hand of the user by inserting fingers of the user into the opening: placing the elongate tool along the longitudinal axis of the band of material such that the first end of the elongate tool is in contact with a portion of the structure to be straightened at a point along the structure to be straightened for which is desired to straight the structure; applying a force to the second end of the elongate tool, the elongate tool lying along the band of material, the band of material acting as a fulcrum point on the elongate tool, such that when the force is applied to the second end of the elongate tool, the first end of the elongate tool applies a desired straightening force to the structure to be straightened at the point along the structure to be straightened for which is desired to straight the structure.

The present method and device of the invention overcome the aforementioned shortcomings of the prior art by providing protection to the hand, knuckles and finger of a user when the user uses a straightening bar, or any elongate structure or tool, to apply straightening forces to a structure to be straightened using the above, or similar, methods.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating exemplary embodiments of the invention and are not to be construed as limiting the invention. In the drawings.

Figure 1:
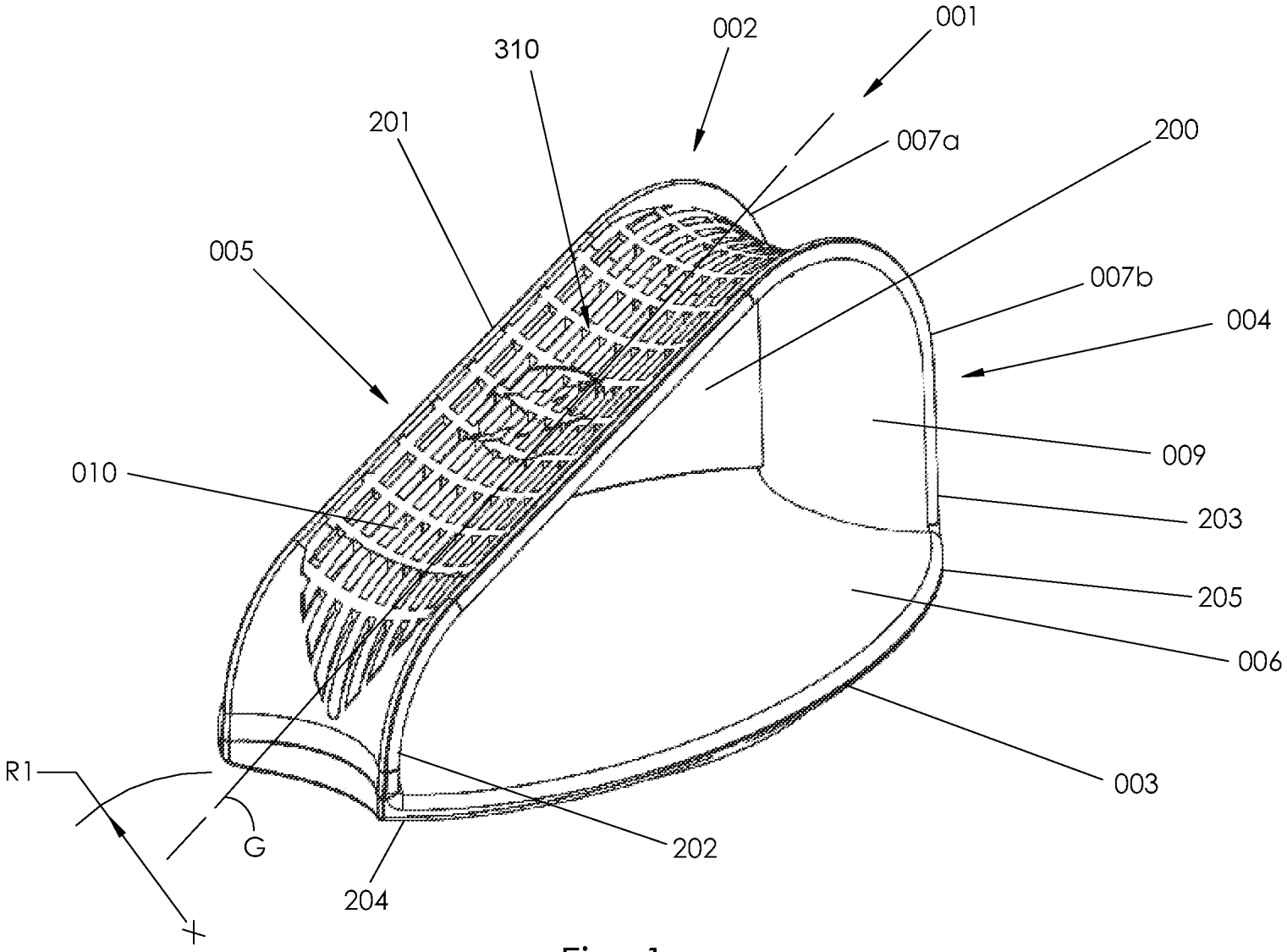
FIG. 1 depicts a left-side perspective view of an exemplary embodiment of the hand protecting device of the invention, taken from above the device, showing a concave surface of the grip portion, and opening 200 for receiving and protecting the hands, fingers and/or knuckles of a user during use.

The drawings of the figures may be shown to scale and shape as to certain embodiments of the invention; but, in other embodiments, the figures should not be interpreted as depicting features of the invention to any particular scale, relative size or shape. In the drawings, like item numbers refer to like features.

DETAILED DESCRIPTION OF THE INVENTION

The following documentation provides a detailed description of the invention.

Although a detailed description as provided in this application contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus, the scope of the invention should be determined by the appended claims and their legal equivalents, and not merely by the preferred examples or embodiments given.

As used herein, "disfiguring forces" includes within its meaning one or more forces that, when acting upon a sheet structure, such as, for example, a sheet metal structure, cause the structure to be deformed such that a surface of the sheet structure no longer conforms to a desired surface shape. i.e. it is a "structure to be straightened".

As used herein, "desired surface shape" includes within its meaning any desired surface shape of a structure. A non-limiting example of a desired surface shape is a plane, which plane may be flat or may be a curved plane. As another non-limiting example, the desired surface shape may be that of a compound curved plane that is characterized by two or more different curvilinear cross sections of the sheet structure. These are just a few non-limiting examples of the types of resulting desired surface shapes that may be achieved using the apparatus of the invention when the apparatus is used to assist user to straighten a structure to be straightened that has been deformed by one or more disfiguring forces. The desired surface shape may be any two-dimensional or three-dimensional surface shape desired by a user.

As used herein, "structure to be straightened" refer to a structure surface having undesired deformities that depart from a desired surface shape, for which the removal of the deformities such that the structure is substantially returned to a desired surface shape ("straightening") is desired. Such undesired deformities may be the result of the prior application of disfiguring forces to a sheet structure. As a non-limiting example, a structure to be straightened may be a sheet metal body structure of an automobile, truck, or trailer.

Referring now to FIG. 1, a left-side perspective view of an exemplary embodiment of the hand protecting device 001 is depicted. The hand protecting device 001 may comprise a base portion 003 and a grip portion 005, which form an opening 200 for receiving the hand, fingers and/or knuckles of a user when the hand protecting devices is being used by a user to straighten a structure to restore a desired surface shape in the structure. The grip portion 005 may be formed of a band of material having a longitudinal axis G, the band of material having a first end 202 and a second end 203, and the band of material having a thickness T3 (see FIG. 5) and a width W (see FIG. 6). The base portion 003 may also have a thickness T4 (see FIG. 9). The band first end 202 may be connected to a first end of the base portion 204, and the band second end 203 may be connected to a second end of said base portion 205 forming an intersection of the band of material forming grip portion 005 and the top surface 006 of base portion 003 defined by a radius R1. The connection of grip portion 005 and the base portion 003 form an opening 200 for receiving at least a portion of the hand, fingers and/or knuckles of a user.

Still referring to FIG. 1, grip portion 005 may comprise a supporting portion 004, a straight portion 201, and a radius portion 002 connecting supporting portion 004 and straight portion 201. Supporting portion 004, straight portion 201 and radius portion 002 may be formed as a part of the band of material comprising grip portion 005. Supporting portion 004 and radius portion 002 may comprise sidewalls 007*a* and 007*b* to provide stiffness to supporting portion 004, as supporting portion 004 will be placed in compression when the hand protecting device 001 is placed at a fulcrum point E, between a straightening tool 300 and a fulcrum structure 301, and a force F is applied to the straightening tool 300 as described herein and shown in FIG. 7.

Figure 4:
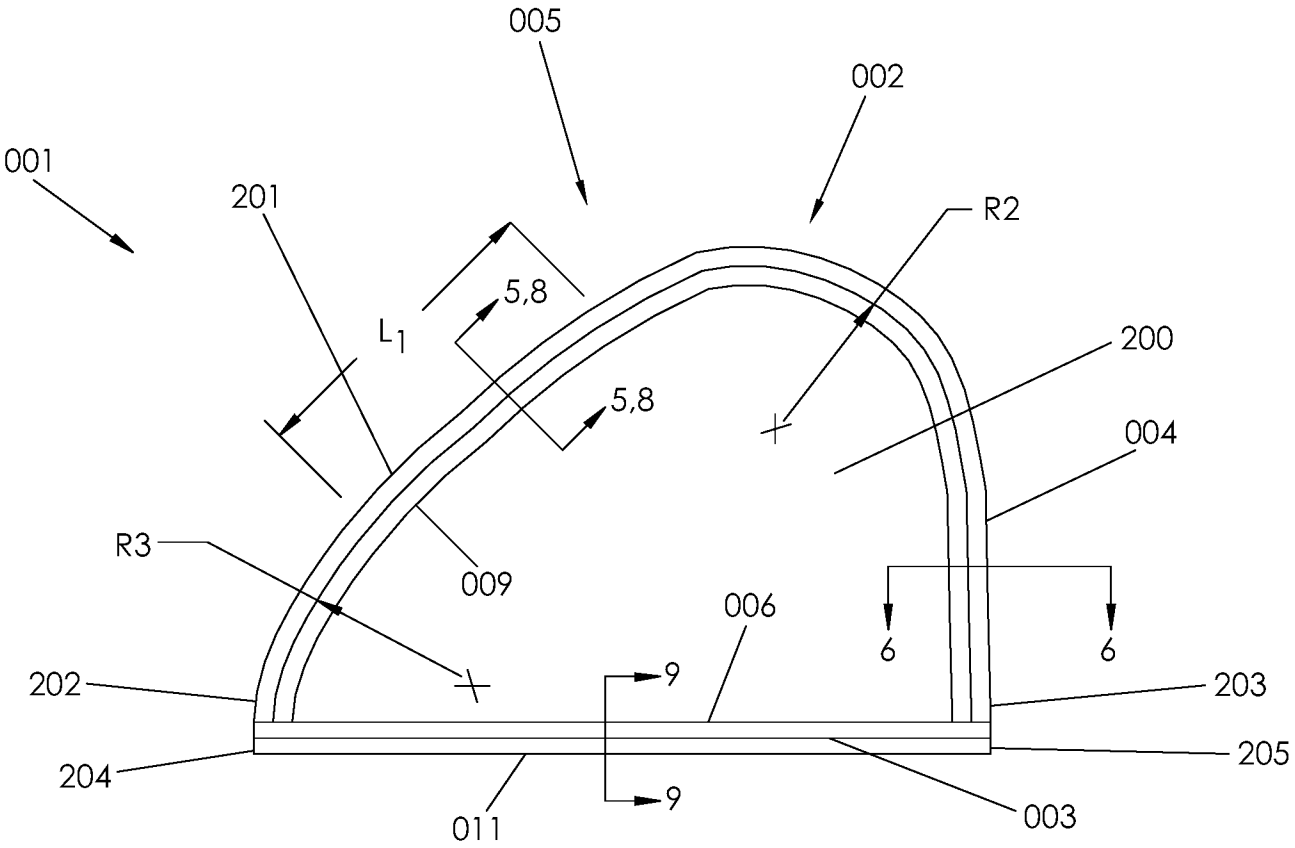
FIG. 4 depicts a right-side view of an exemplary embodiment of the hand protecting device of the invention.
Figure 5:
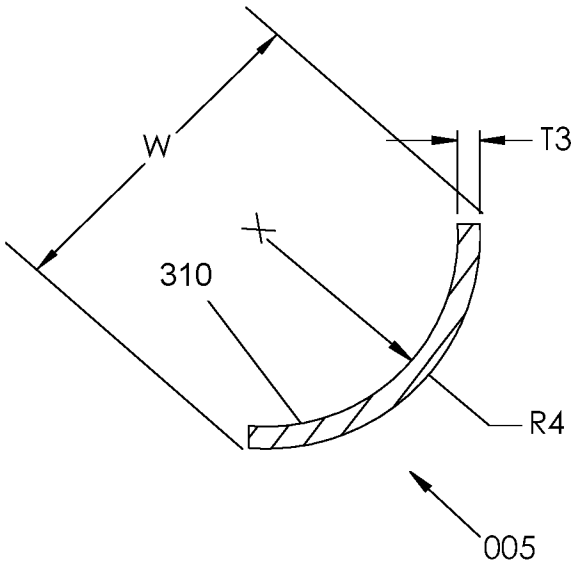
FIG. 5 depicts a cross section view of the grip portion of an exemplary embodiment of the hand protecting device of the invention, showing a curvilinear cross sectional shape of the grip portion in a direction transverse to the longitudinal axis of the band of material forming the grip portion, the curvilinear cross sectional shape forming a concave side of the grip portion, and the concave side of the curvilinear cross sectional shape being oriented away from the base portion.
Figure 7:
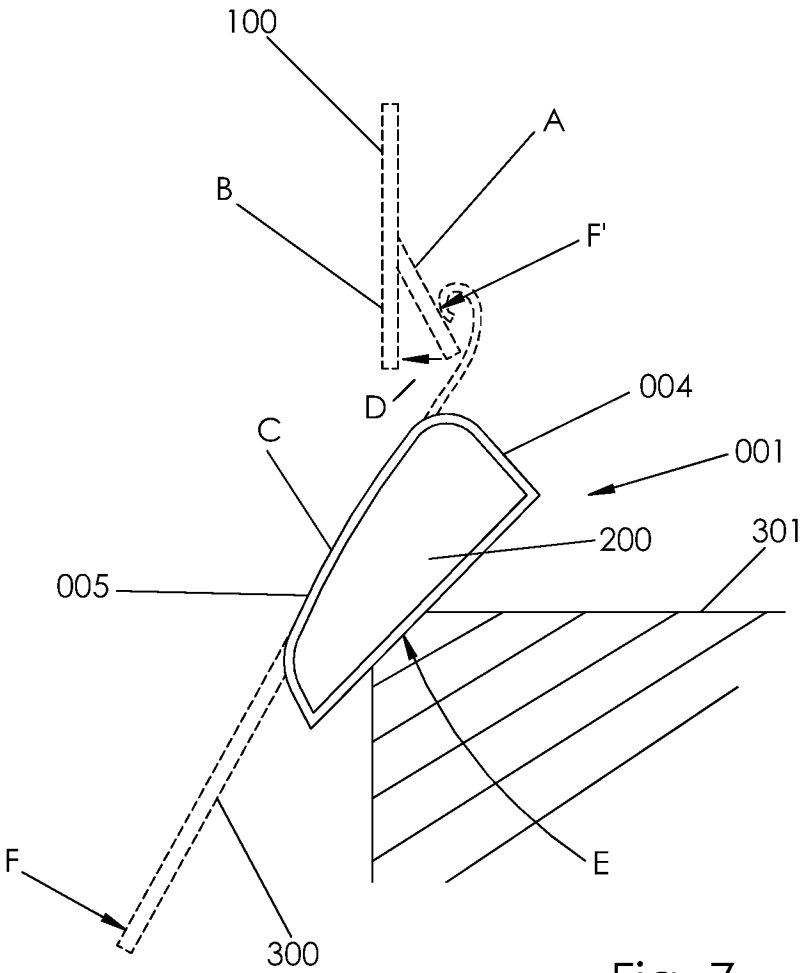
FIG. 7 depicts a side view of an exemplary embodiment of the invention in an exemplary, non-limiting use case, as it may be used to prevent the crushing of the fingers and hands of a user when the user uses a straightening tool to return a sheet structure to its desired surface shape.
Figure 8:
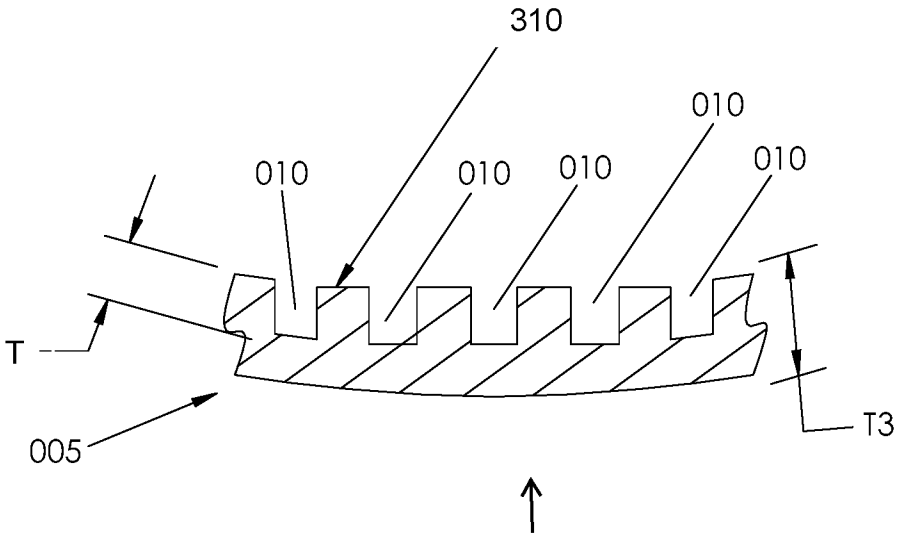
FIG. 8 depicts an exemplary embodiment of a cross section of the grip portion of the invention.

Still referring to FIG. 1, grip portion 005 may be arcuately shaped in cross section as depicted in FIGS. 5 and 8. Grip portion 005 may have an upper surface 310, which may, but does not necessarily, comprise one or more non-skid features to prevent a straightening tool, such as straightening tool 300 depicted in FIG. 7, from sliding along grip portion upper surface 310 when straightening tool 300 is being placed on grip portion upper surface 310 to align for use, or when force F is applied when the straightening tool 300 is used to apply a straightening force L1' to a structure or surface to be straightened 100 (see FIG. 7). The optional non-skid features may, but do not necessarily, take the form of one or more voids 010 in grip portion upper surface 310. Each of the optional voids may, or may not, extend all the way through the thickness of the material band comprising grip portion 005. Grip portion 005 may have an interior surface 009 that is smooth or may comprise any non-skid features known in the art. Base portion 003 may have a maximum width T. The shape of base portion 003 may be any shape, including any arbitrary, free-form, rectangular, polygon or any other shape, but in embodiments may be elliptical or oval shaped, the ellipse or oval defined as having a width T and a length S (see FIG. 4).

Figure 2:
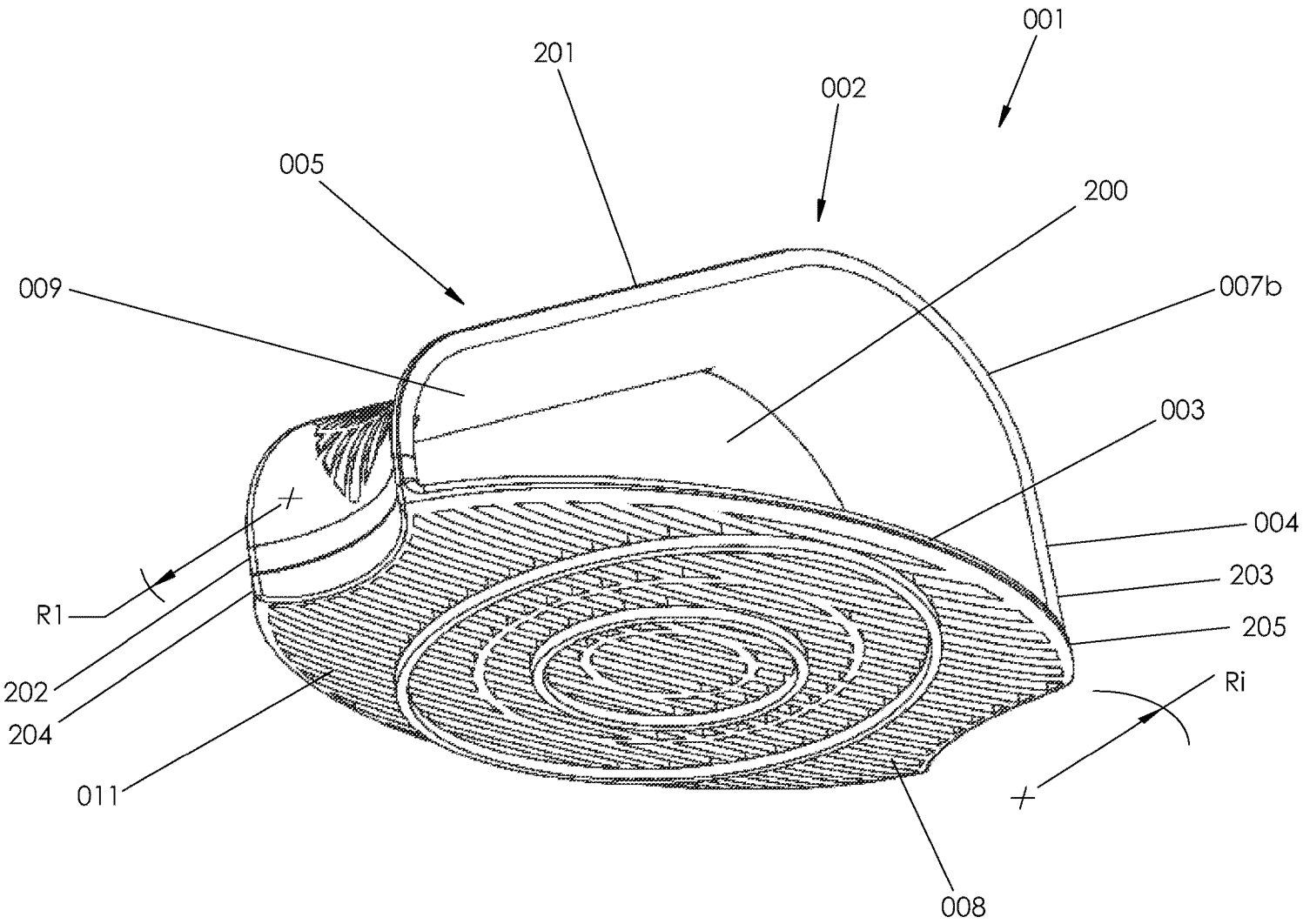
FIG. 2 depicts a perspective bottom view of an exemplary embodiment of the hand protecting device of the invention, showing the bottom surface of the base portion, and opening 200 for receiving and protecting the hands, fingers and/or knuckles of a user during use.

Referring now to FIG. 2, a perspective bottom view of an exemplary embodiment of the hand protecting device 001 is depicted. Grip portion 005, which is comprised of supporting portion 004, radius portion 002 and straight portion 201, is shown for reference. The radius R1, defining the intersection of the first end 202 of grip portion 005 to first end 204 of base portion 003 and the intersection of second end 203 of grip portion 005 to second end 205 of base portion 003 are also shown for reference; and grip portion sidewall 007*b*, grip portion interior surface 009 and opening 200 are also shown for reference. Base portion 003 may comprise a bottom surface 011, which may, but does not necessarily, comprise one or more non-skid features to prevent the bottom surface 011 of base portion 003 from sliding along a surface of fulcrum structure 301 when the hand protecting device 001 is being placed on the surface of fulcrum structure 301 to align the hand straightening device 001 for use, or when force F is applied when the straightening tool 300 is used to apply a straightening force L1' to a structure or surface to be straightened 100 (see FIG. 7). The optional non-skid features may, but do not necessarily, take the form of one or more voids 008 in base plate bottom surface 011. Each of the optional voids 008 may, or may not, extend all the way through the thickness of the material comprising base portion 003.

Figure 3:
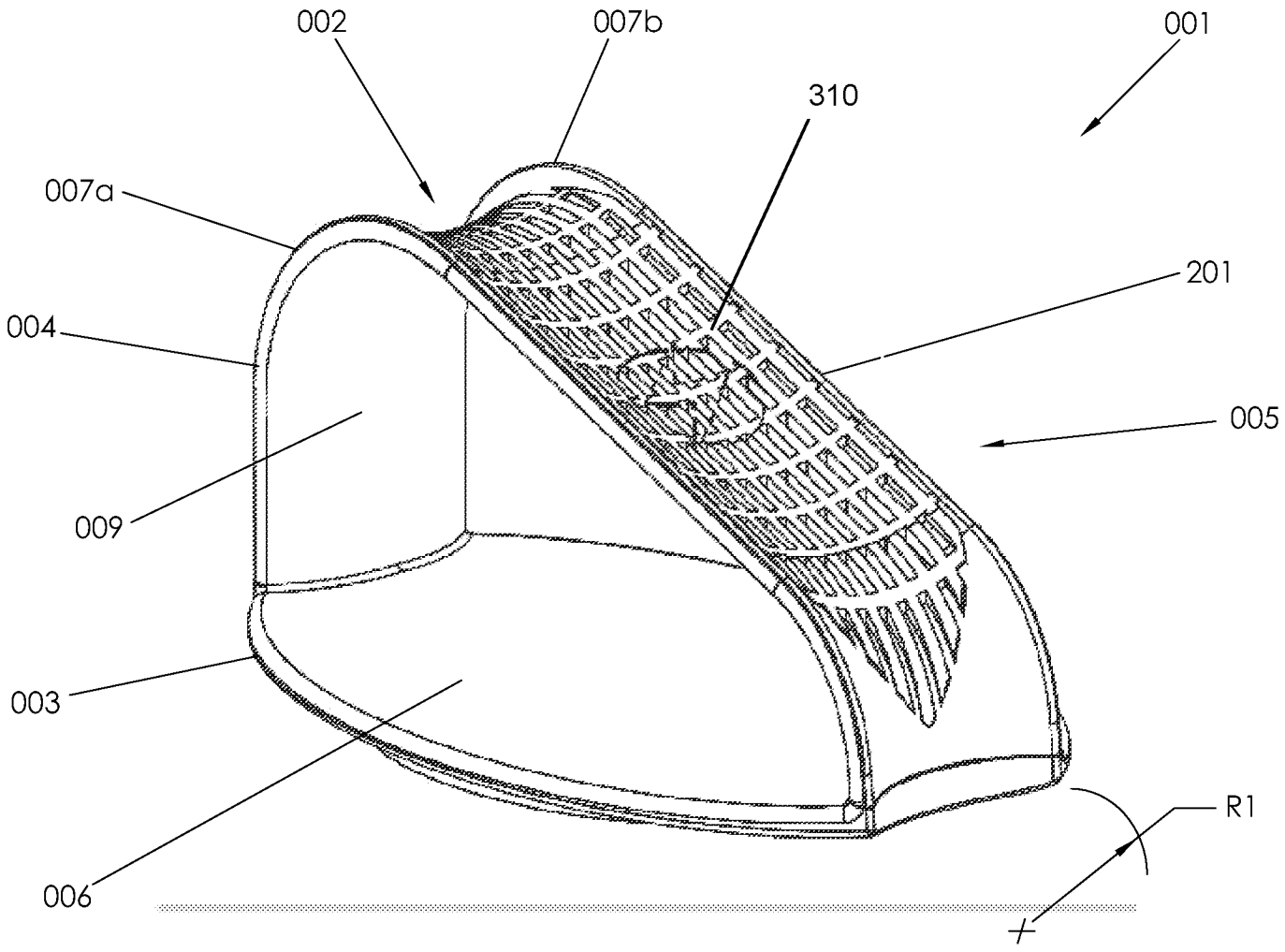
FIG. 3 depicts a perspective top view of an exemplary embodiment of the hand protecting device of the invention, taken from above the device, showing a concave surface of the grip portion.

Referring now to FIG. 3, a perspective top view of an exemplary embodiment of the hand protecting device 001 is depicted. Base portion 003, having a top surface 006, and grip portion 005, comprising supporting portion 004, radius portion 002, straight portion 201, grip portion upper surface 310, sidewalls 007*a* and 007*b*, and interior surface 009 are depicted for reference. R1 is also shown for reference.

Referring now to FIG. 4, a right side view of an exemplary embodiment of the hand protecting device of the invention 001 is depicted. Base portion 003, having a top surface 006 and bottom surface 011; and grip portion 005, comprising supporting portion 004, radius portion 002, straight portion 201 having a length L1, grip portion interior surface 009, and opening 200 are depicted for reference. The intersection of first end 202 of grip portion 005 to first end 204 of base portion and the intersection of second end 203 of grip portion 005 to second end 205 of base portion 005 are also shown for reference. Radius portion 002, which connects supporting portion 004 to straight portion 201, may be defined by radius R2 or any other arcuate shape. Straight portion 201 may be attached to base portion 003 by a grip portion defined by radius R3.

Referring now to FIG. 5, an embodiment of a cross section view of grip portion 005 is depicted. In the straight portion 201 and continuing along grip portion 005 to the point where it connects to base portion 003 at its first end 202 as depicted in FIGS. 1, 2, 3 and 4, grip potion 005 may be, but is not necessarily, defined as having width W, a cross section having a radius R4 and a thickness T3. In embodiments, R4 may be equal to R1. Straight portion 201 may comprise grip portion upper surface 310 for all, or a portion of, or more than, its length L1 (see FIG. 4).

Figure 6:
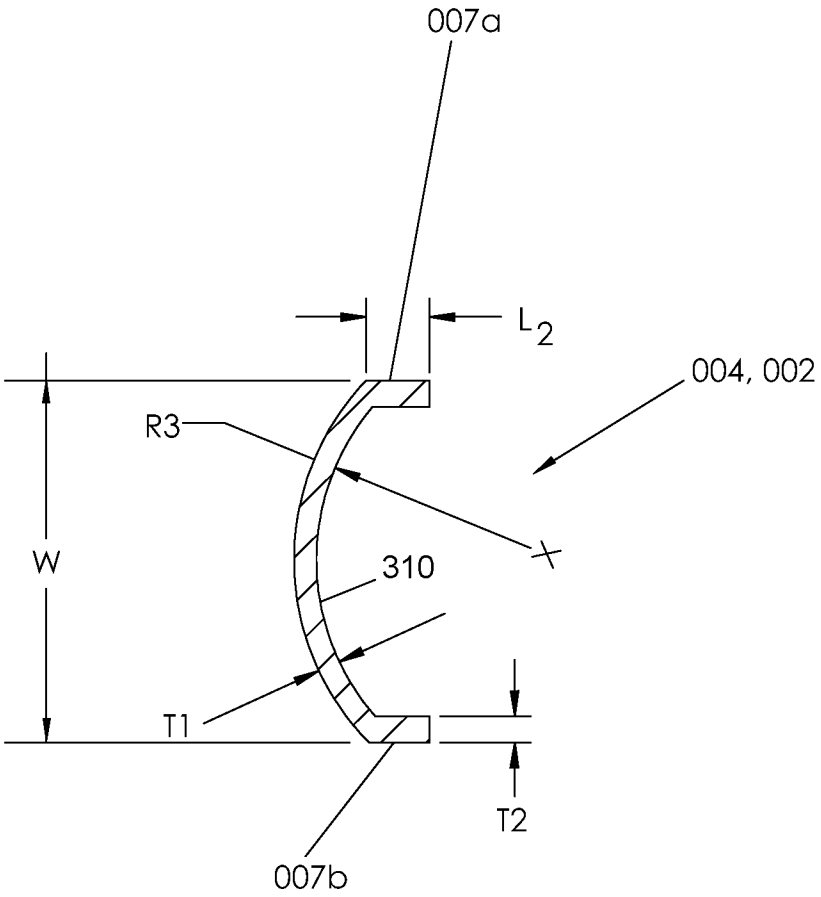
FIG. 6 depicts a curvilinear cross section view of the supporting portion of an exemplary embodiment of the hand protecting device of the invention.

Referring now to FIG. 6, an embodiment of a curvilinear cross section of grip portion 005 is depicted. In the radius portion 002 and continuing along grip supporting portion 004 to the point where it connects to base portion 003 at its second end 203 as depicted in FIGS. 1, 2, 3 and 4, grip potion 005 may be, but is not necessarily, defined as having width W, a cross section having a radius R3, a thickness T1, and optional sidewalls 007*a* and 007*b* having a depth L2. Optional sidewalls 007*a* and 007*b* operate to provide additional stiffness to radius portion 002 and grip supporting portion 004 proportional, at least in part, to the depth of the sidewalls L2. The greater the depth of sidewalls L2, the greater the load that can be supported by hand protecting device of the invention 001 with it is used, for example, as shown and described in relation to FIG. 7. Thus, in embodiments, L2 may be tailored to support a desired load placed upon it by the straightening tool 301 (see FIG. 7). In embodiments, R4 may be equal to R1. In embodiments, T1 may equal T3. The curvilinear cross sectional shape of grip portion 005 is oriented in a direction transverse to the longitudinal axis G of the band of material forming the grip portion 005 (see FIG. 1), the curvilinear cross sectional shape forming a concave side of the grip portion at surface 310, the concave side of the curvilinear cross sectional shape, i.e. surface 310, being oriented away from the base portion 003 (see also FIGS. 1 and 3).

Referring now to FIG. 7, a side view of an embodiment of the hand protecting device of the invention 001 in use, as it may be used to prevent the crushing of the fingers and hands of a user when the user uses a straightening tool to return a sheet structure to its desired surface shape, is depicted. In this example of use, a structure 100 has been deformed by disfiguring forces along portion A. For example, structure 100 could be a sheet metal portion of an automobile body which has suffered damage by the disfiguring forces of an automobile crash. It may be desired to return portion A to its un-deformed, i.e., original state depicted as portion B. Thus, portion A of structure 100 is a structure to be straightened, and the desired surface shape is B. One method for achieving this is to apply straightening force F' to motivate and force portion A back into desired surface shape B along a path D. F' may be achieved using a straightening tool 300 to act as a lever having a fulcrum point E, where a compressive force is generated at point E by the application of force F on straightening tool 300, resulting in straightening force F' on portion A by the lever action of straightening tool 300 operating against fulcrum structure 300 at fulcrum point E. Generally, it is desirable for a user (i.e. an operator) to place all, or a portion of, their hand between straightening tool 300 and fulcrum structure 300 at fulcrum point E in order to guide the point of contact between the upper end of the straightening tool and portion A, in order to apply the right amount of straightening force F' at exactly the right point of portion A, in order to accurately motivate and force portion A back into position B along a path D such that the desired straightening of portion A of structure 100 is achieved, resulting in the desired surface shape B. However, the placement of the user's hand in the position between straightening tool 300 and fulcrum structure 300 at fulcrum point E causes the user's hand to be subject to the compressive forces at fulcrum point E, causing physiological damage to the user's hands resulting in numbness, pain, and in some case, nerve or other physiological damage to the user. However, the use of the hand protecting device of the invention 001 prevents such physiological damage to the hand, fingers and knuckles of the user by providing hand protecting opening 200 into which the user may place their hand or fingers. In doing so, the user is able to use their hand and fingers at fulcrum point E to guide the point of contact between the upper end of the straightening tool and portion A, in order to apply the right amount of straightening force F' at exactly the right point of portion A, in order to accurately motivate and force portion A back into position B along a path D such that the desired straightening of portion A of structure 100 is achieved, resulting in the desired surface shape B, while the hand protecting tool absorbs and resists the compressive forces generated at fulcrum point E when the hand protecting device 001 is used in conjunction with a straightening tool 300 as shown in FIG. 7. In this manner, the hand protecting device 001 protects the hand(s), finger(s) and knuckle(s) of the user while still allowing the user to use their hand and fingers to guide the point of contact between the upper end of the straightening tool and portion A, in order to apply the right amount of straightening force F' at exactly the right point of portion A, in order to accurately motivate and force portion A back into position B along a path D such that the desired straightening of portion A of structure 100 is achieved, resulting in the desired surface shape B Referring now to FIG. 8, an exemplary embodiment of a cross section of the grip portion 005 of the invention is depicted, showing the thickness of the grip portion T3, and showing an embodiment of the non-skid, or friction-inducing, features in the form of one or more voids 010 in surface 310. Voids 010 may be of any depth T as desired by a user, including passing all the way through thickness T3, as long as they do not weaken the structure of grip portion 005 to the point that structural failure occurs upon the application of desired loads as discussed in relation to FIG. 7, and shown in FIG. 7. Any number of voids 010 or other non-skid, friction-inducing surface features, in any combination or pattern, may be present in surface 310 of grip portion 005.

Figure 9:
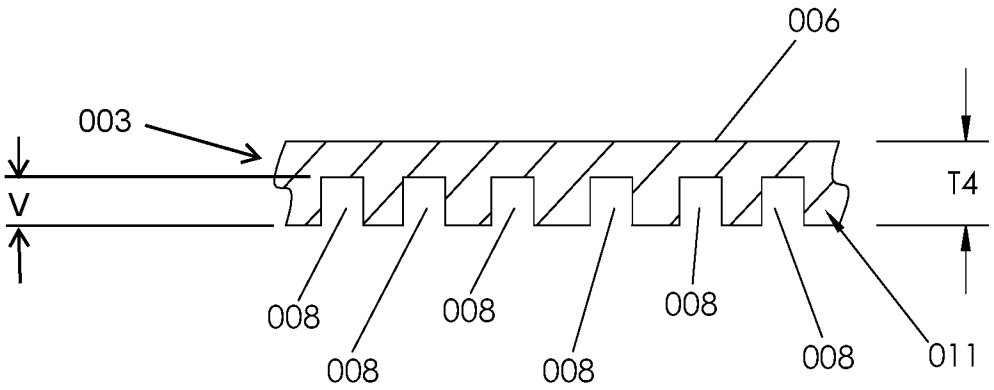
FIG. 9 depicts an exemplary embodiment of a cross section of the base portion of the invention.

Referring now to FIG. 9, an exemplary embodiment of a cross section of the base portion of the invention 003 is depicted, showing the thickness of the bottom portion T4, and showing an embodiment of the non-skid, or friction-inducing, features in the form of one or more voids 008 in surface 011 of base portion 003. The invention many comprise any number of voids 008, in any shape or configuration. Voids 008 may be of any depth V as desired by a user, including passing all the way through thickness T4, as long as they do not weaken the structure of base portion 003 to the point that structural failure occurs upon the application of desired loads as discussed in relation to FIG. 7, and shown in FIG. 7. Any number of voids 008 or other non-skid, friction-inducing surface features, in any combination or pattern, may be present in surface 011.

In embodiments, the hand protecting device 001 may comprise, and be assembled from, any number of separate pieces that may be attached by chemical bonding, welding, brazing, or any other means for fabrication of mechanical devices know in the art. In embodiments, the hand protecting device 001 may be molded, cast, forged or otherwise formed of a single unitary structure. The hand protecting device 001 may comprise any structural material including plastic, composite materials, metals, phenolics, laid-up materials, wood, or any other material able to withstand the anticipated loads resulting from use of the hand protecting device 001.

The features and elements of the hand protecting device 001 described herein and depicted in the figures of the drawings are shaped so as to supporting the anticipated applied forces of use as depicted in FIG. 7 with experience structural failure, thus protecting the hands, fingers, and/or knuckles of the user when the hand protecting device 001 is used as shown and described.

What is claimed is:

1. A hand protecting device, comprising:

a structure having a base portion and a grip portion;

wherein the grip portion is formed of a band of material having a longitudinal axis, the band of material having a first end and a second end, and the band of material having a thickness and a width;

the band of material having sidewalls to provide stiffness;

the base portion has a thickness; and the band first end is connected to a first end of said base portion, and the band second end is connected to a second end of said base portion, such that the band portion and the base portion form an opening for receiving at least a portion of the hand of a user;

wherein, when a compressive load is applied along the band of material, the load is resisted by the structure, preventing the crushing of a portion of a user's hand that has been inserted into the opening.

2. The hand protecting device of claim 1, wherein the base portion and grip portion are formed of a unitary structure, such that the base portion and the grip portion are formed of a single continuous material structure.

3. The hand protecting device of claim 2, wherein the unitary structure is formed by molding.

4. The hand protecting device of claim 2, wherein the base portion and the grip portion are comprised of plastic material.

5. The hand protecting device of claim 3, wherein the base portion and the grip portion are comprised of plastic material.

6. The hand protecting device of claim 1, wherein the grip portion comprises a curvilinear cross sectional shape in a direction transverse to the longitudinal axis of the band of material forming the grip portion, the curvilinear cross sectional shape forming a concave side of the grip portion, and wherein the concave side of the curvilinear cross sectional shape is oriented away from the base portion.

7. The hand protecting device of claim 6, wherein the concave side of the grip portion comprises a plurality of voids.

8. The hand protecting device of claim 1, wherein a bottom side of the base portion comprises a plurality of voids.

9. The hand protecting device of claim 1, wherein the grip portion comprises a straight portion that is straight in a plane that is parallel with the longitudinal axis of the band of material forming the grip portion, the straight portion having a length.

10. The hand protecting device of claim 9, wherein a plurality of voids in the grip portion extends for the length of the straight portion.

* * * * *